US008172600B2

(12) United States Patent
Trottier et al.

(10) Patent No.: US 8,172,600 B2
(45) Date of Patent: May 8, 2012

(54) EXTENSION CABLE WITH SEVERAL GROUPS OF WIRES OF DIFFERENT LENGTHS CONNECTED TO A PLUG HAVING AN ANTI-ROTATION RING AND A COMPRESSION CLAMP

(75) Inventors: Robert R. Trottier, Andover, MA (US); Daniel Maguire, Burlington, MA (US)

(73) Assignee: Scully Signal Company, Wilmington, MA (US)

( * ) Notice: Subject to any disclaimer, the term of this patent is extended or adjusted under 35 U.S.C. 154(b) by 0 days.

(21) Appl. No.: 13/081,262

(22) Filed: Apr. 6, 2011

(65) Prior Publication Data

US 2011/0244704 A1 Oct. 6, 2011

Related U.S. Application Data

(60) Provisional application No. 61/321,396, filed on Apr. 6, 2010, provisional application No. 61/348,054, filed on May 25, 2010.

(51) Int. Cl.
*H01R 4/24* (2006.01)

(52) U.S. Cl. ..... 439/392

(58) Field of Classification Search ..... 439/345, 439/392, 449, 567

See application file for complete search history.

(56) References Cited

U.S. PATENT DOCUMENTS

| | | | | |
|---|---|---|---|---|
| 772,571 | A | 10/1904 | Maxim et al. | |
| 2,000,997 | A * | 5/1935 | Sharpe | 464/58 |
| 3,933,404 | A | 1/1976 | Oehlerking et al. | |
| 5,069,631 | A | 12/1991 | Bauer et al. | |
| 5,300,086 | A * | 4/1994 | Gory et al. | 606/200 |
| 5,346,406 | A | 9/1994 | Hoffman et al. | |
| 6,017,237 | A * | 1/2000 | Sullivan | 439/392 |
| 6,246,001 | B1 * | 6/2001 | Fukui | 174/78 |
| 6,672,894 | B2 * | 1/2004 | Sprunger | 439/449 |
| 6,683,273 | B2 | 1/2004 | Conway et al. | |
| 7,611,381 | B2 * | 11/2009 | Lei | 439/567 |
| 2003/0139087 | A1 * | 7/2003 | Sprunger | 439/449 |
| 2008/0139038 | A1 | 6/2008 | Lee | |

* cited by examiner

*Primary Examiner* — Chandrika Prasad
(74) *Attorney, Agent, or Firm* — Weingarten, Schurgin, Gagnebin & Lebovici LLP

(57) ABSTRACT

A breakaway cable is provided with a plug that has a number of wires that are arranged so as to disconnect in a predetermined sequence. The disconnect plug is designed to fit into a standard plug assembly. This end of the plug presents the same set of pins as a truck, thus extending the existing cable by the extender length. The breakaway cable is configured to break in a controlled manner in the event a vehicle to which the cable is connected should pull away.

21 Claims, 9 Drawing Sheets

EXTENSION CABLE WITH SEVERAL GROUPS OF WIRES OF DIFFERENT LENGTHS CONNECTED TO A PLUG HAVING AN ANTI-ROTATION RING AND A COMPRESSION CLAMP

CROSS REFERENCE TO RELATED APPLICATIONS

This application is a non-provisional application claiming priority from U.S. Provisional Patent Application No. 61/321,396 filed Apr. 6, 2010 entitled "Extension Cable With Sequenced Disconnect" and from U.S. Provisional Patent Application No. 61/348,054 filed May 25, 2010 entitled "Post-Connection Alignment Mechanism."

BACKGROUND OF THE INVENTION

In the fuel loading industry where a fuel truck is being loaded with liquid that is often flammable, in order to meet mandated safety requirements, several parameters of the fuel transfer are routinely monitored for compliance with loading operations standards. These systems, generally, connect to sensors on vehicles, for example, tanker trucks, that verify system and truck status prior to beginning a filling process. In some instances, the system is checked to verify that a ground connection is established in addition to determining that the sensors in the tanks are dry, in other words, the tanks are not already full and, therefore, there is no risk to filling the tanks and causing a spill. As known, these connections are established using industry standard connecting plugs and terminals that the fuel trucks and the loading racks must each provide.

The sensors on the vehicle being filled, often a tanker truck, are connected to a controllers at a loading rack that must detect a safe condition before allowing fuel to flow. The connections between the vehicle and the loading rack are accomplished through multi-conductor cables and plug/socket assemblies. The plug and socket connect to one another with a set of interlocking pins and associated "J" slots. These cables are typically coiled and terminate in a junction box at the rack end of the cable.

During normal operation, after the fuel loading has completed, the cables are intended to be disconnected by the truck driver or operator. On occasion, however, a driver forgets to remove the cable and drives off with it still connected between the now moving truck and the stationary rack resulting in damage to both the cable and the rack equipment.

While there are several approaches available to prevent a driver from pulling away without first removing the cable they are either not universally in use, frequently ignored or actively over-ridden.

What is needed is a mechanism to minimize the amount of damage that is incurred when a truck pulls away from a fueling rack with a sensor cable still attached. In addition, a solution to reducing damage from "runaway" trucks must also accommodate the different types of connectors that may be found in a fleet of tanker trucks

BRIEF SUMMARY OF THE INVENTION

Embodiments of the present invention prevent damage to loading racks and associated cabling by providing an extension cable with a sequenced disconnect mode of operation such that the cable is designed to come apart or release at forces below which any damage is done to the rack equipment. The design is such that the disconnect is sequenced and can be calibrated, or set, to accommodate different force requirements that will avoid damage to the rack in the event a connected truck pulls away.

One embodiment of the present invention consists of a cable that has at one end a standard plug assembly as is currently used to connect to a vehicle. The other end is provided with a plug that has a number of wires that are arranged so as to disconnect in a predetermined sequence. The disconnect plug is designed to fit into a standard plug assembly. This end of the plug presents the same set of pins as a truck thus simply extending the existing cable by the extender length. The interconnection method is the same pin/"J" slot used to connect to a vehicle.

Another embodiment of the present invention provides for more secure connection of the cable in those instances where the number of slots may lead to a pivoting of the connector and, therefore, an intermittent signal.

BRIEF DESCRIPTION OF THE SEVERAL VIEWS OF THE DRAWINGS

Various aspects of at least one embodiment of the present invention are discussed below with reference to the accompanying drawings. It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous elements. For purposes of clarity, not every component may be labeled in every drawing. The drawings are provided for the purposes of illustration and explanation and are not intended as a definition of the limits of the invention. In the figures.

DETAILED DESCRIPTION OF THE INVENTION

This application is a non-provisional application claiming priority from U.S. Provisional Patent Application No. 61/321,396 filed Apr. 6, 2010 entitled "Extension Cable With Sequenced Disconnect" and from U.S. Provisional Patent Application No. 61/348,054 filed May 25, 2010 entitled "Post-Connection Alignment Mechanism," the entire contents of each of which are hereby incorporated by reference for all purposes.

Figure 1:
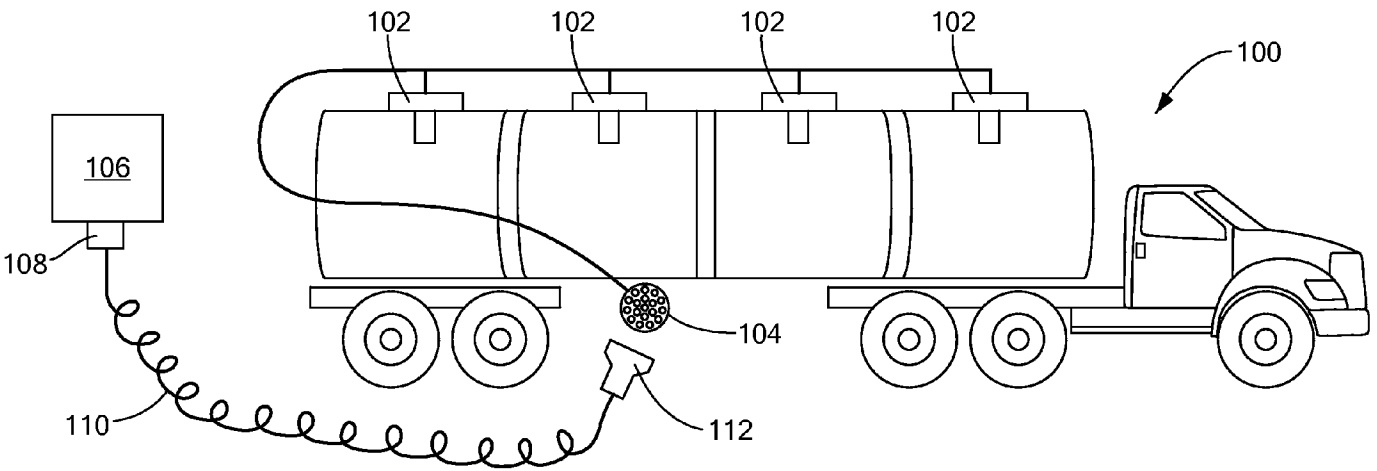
FIG. 1 is a representation of a common truck fueling arrangement.

Referring now to FIG. 1, a tanker truck 100 includes a number of sensors 102 that are accessed through a socket 104. Rack equipment 106 may include a junction box with a strain relief portion 108 attached to a coiled cable 110. At the end of the coiled cable 110, a plug 112 is provided to mate with the socket 104 on the truck 100 in order for the rack 106 to read the sensors 102 in order to determine if fuel loading will be continued.

Figure 2:
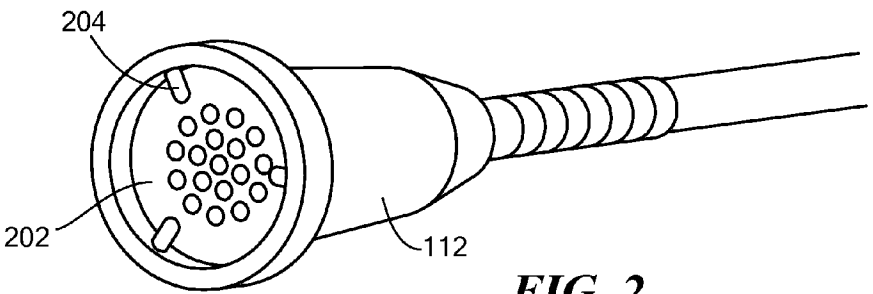
FIG. 2 is a known plug and cable configuration.

Referring now to FIG. 2, the plug 112 includes a number of spring loaded pins 202 to mate with the socket 104. In addition, a number of locking pins 204 are provided to confirm a mechanical coupling between the plug 112 and the socket 104.

Figure 3:
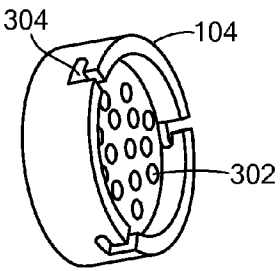
FIG. 3 is a known socket configuration.

The socket 104, as shown in FIG. 3, includes fixed pins or contacts 302 and a "J" slot 304 oriented to accept the corresponding pins 202 and the locking pins 204 of the plug 112, respectively.

One of ordinary skill in the art will understand that the plug 112 may include male pins 202 to receive/transmit signals to the sensors 102 as well as female sockets or flat contacts to perform the same function. It is not germane to the concepts here whether or not there are pins or receivers in the plug 112 and socket 104 and vice versa.

Figure 4:
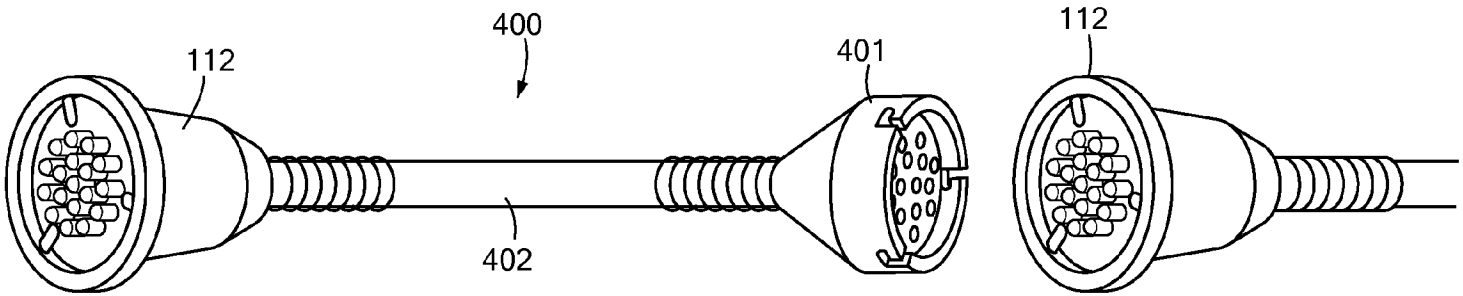
FIG. 4 is a representation of a breakaway cable in accordance with an embodiment of the present invention.

As shown in FIG. 4, an extension cable 400 with sequenced disconnect according to one embodiment of the present invention consists of an extension cord or cable 402 that has at one end a standard plug assembly 112 as is currently used to connect to a vehicle or truck 100. The other end is provided with a disconnect plug 401 that has a number of wires that are arranged so as to disconnect in a predetermined sequence. The disconnect plug 401 is designed to fit into a standard plug assembly 112. The disconnect plug 401 presents the same set of pins as a truck thus extending the existing cable by the extender length. The interconnection method is the same pin/"J" slot used to connect to a vehicle.

Figure 5:
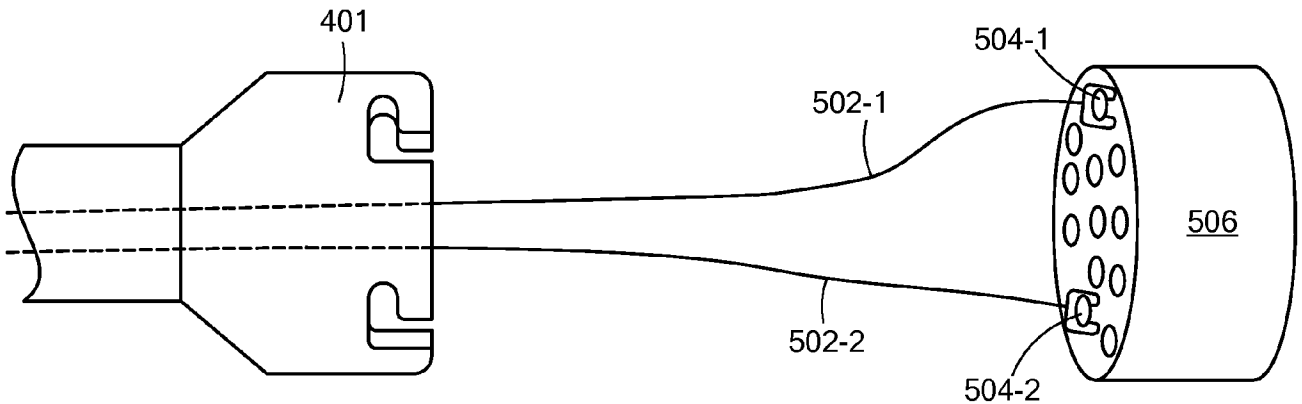
FIG. 5 is an exploded view of a portion of the breakaway cable of FIG. 4.

The extension cable 400 comprises a number of wires 502-*n* with connecters on the ends and then coupled, via screws 504-*n*, to an inner puck portion 506 of the disconnect plug 401, as shown in FIG. 5. The inner puck portion 506 is positioned in the disconnect plug 401.

This sequenced disconnect plug 401 is designed to disconnect the wires 502 in a controlled sequence when a force in excess of normal operation is applied, for example, when a vehicle drives off with the cable attached to it.

Figure 6:
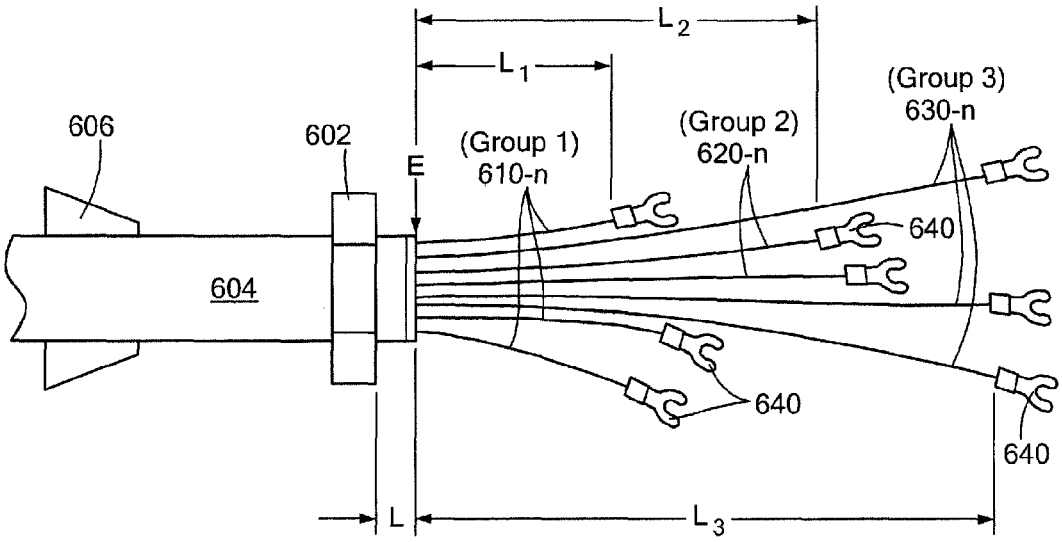
FIG. 6 is a representation of the internal wires in the breakaway cable of FIG. 4.

The sequenced disconnect plug 401 has a breaking sequence with several steps due to a configuration of the wires as shown in FIG. 6.

As an overview, a wire sequence consists of a number of sets of wires (Group 1) 610-*n*, (Group 2) 620-*n*, (Group 3) 630-*n*, respectively, cut to different lengths, $L_1$, $L_2$, $L_3$, respectively, as measured from a specific point E, i.e., an end of the cable outer jacket, and attached to the puck assembly portion 401 by screws 504. The screws are tightened to the same setting. Thus, the wires of each group are the same length but different from the lengths of the wires in the other groups. In addition, the number of wires in each group may differ and are chosen to provide the desired release characteristics where, generally, each wire releases at the same force so grouping will provide predictable levels. Further, a wire carrying a particular signal, e.g., ground, may be chosen to be in the group that disconnects last for safety or operation and, conversely, other signal wires may be chosen to disconnect first. Thus, a controlled functional disconnect can also be obtained.

Here, for example, as shown in FIG. 6, the wires 610-*n* of Group 1 are shorter than the wires 620-*n* of Group 2 which are shorter than the wires 630-*n* of Group 3. Each of these wires is terminated with a crimp connector 640. These crimps 640 are attached by calibrated presses and strength monitored and tested in manufacturing. As a result, each crimp connector 640 requires the same amount of force to pull the wire out. By attaching the crimps 640 to the wires 610-*n*, 620-*n*, 630-*n*, at different lengths, the sequence of wires releasing can be preset. Thus, the shortest wires release first, and the force being exerted on the cable assembly can be controlled by the number of wires at each length, i.e., the number of wires in each group, as the disconnect forces of the terminals are additive.

Figure 8A:
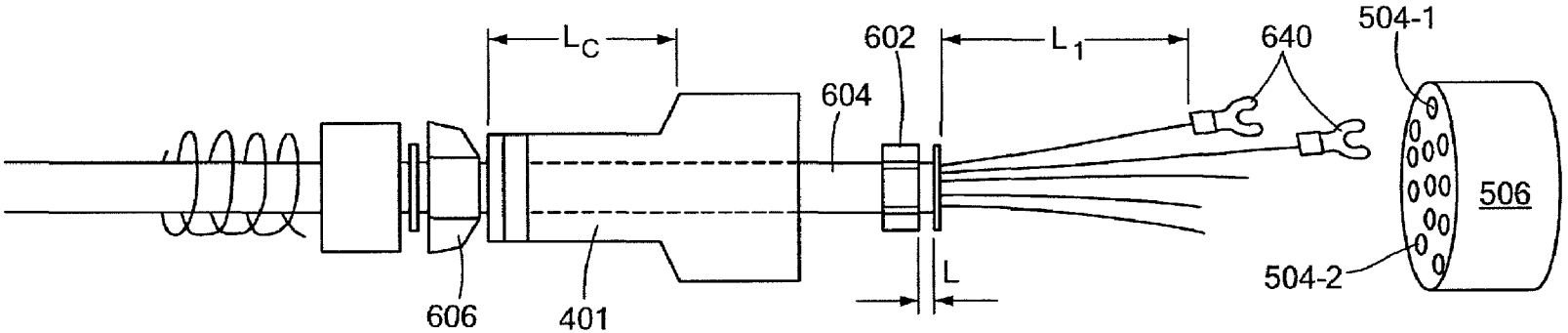
FIGS. 8A and 8B are exploded and cutaway views of the breakaway cable of FIG. 4.
Figure 9B:
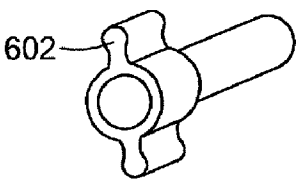
FIGS. 9A and 9B are views of an anti-rotation portion of the breakaway cable.
Figure 9A:
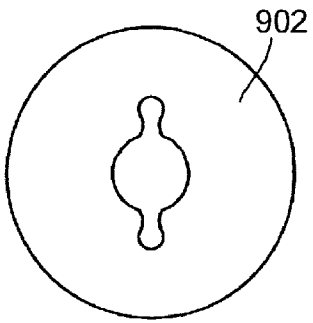

It is necessary to prevent the normal forces, i.e., those forces encountered in everyday use, from damaging the wires, prematurely releasing the cable assembly, or deteriorating the integrity of the wire sequencing. As shown in FIG. 8A, an exploded view of the assembly, the assembly includes an anti-rotation or anti-twist ring or clamp 602 that prevents the cable from rotating in the plug 401. The clamp 602 is a compressed ring that has ears on it that mate to a matching pocket 902 in the plug assembly that limits the cable rotation as shown in FIGS. 9A and 9B. The anti-rotation ring 602 is positioned almost at the end of the cable outer jacket 604 to allow the ring 602 to slide off the outer jacket 604 of the cable. In addition, the assembly includes a compression clamp 606 that is compressed by a compression nut as known and that is designed to hold against a force in excess of that amount seen in normal use but less than a force that would cause another portion of the cable system to fail. The ring 602 and clamp 606 serve to prevent the "normal" or everyday forces from detaching the wires.

It is noted that the attachment of the anti-rotation clamp 602 and the compression clamp 606 on the cable are predetermined and precise and it is important that several predefined distances be maintained.

To assure the proper sequence of disconnect, as shown in FIG. 8A, a distance $L_1$ from an end of the outer jacket 604 to the terminal ends, i.e., the crimps, of the shortest group of wires, i.e., the wires 610-*n* of Group 1, must be long enough to assure that the cable jacket 604 has left the plug before the wire sequencing begins. A second distance $L_c$ from the compression clamp 606 to the back of the plug 401 must be chosen such that $L_1 > L_c$. One of ordinary skill in the art understands that the back of the plug is chosen as the point from which this measurement is taken because the inner puck portion 506 cannot be drawn past that point if pulled by a runaway truck.

Figure 8B:
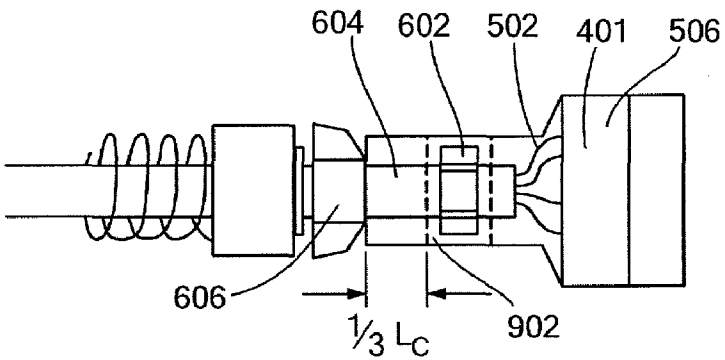

As shown in FIG. 8B, a partial cutaway view, of an assembled breakaway cable, the ring 602 generally is not "bottomed-out" within the pocket 902. The pocket 902 is positioned within the housing 401 such that its backmost or bottom portion is about ⅓of the length $L_c$ from the back of the housing 401.

In operation, therefore, the sequencing of the disconnect is:

1) Force is applied, e.g., due to a runaway connected truck, that exceeds the ability of the compression nut or clamp 606 to hold and the cable sheath starts to slide out.
2) The anti-rotation ring 602 reaches the bottom or back of the pocket 902, shown in FIGS. 8B and 9, and slides off.
3) The cable outer jacket 604 slides through the compression fitting 606 resulting in the compression fitting 606 providing no compression on the wires as the wire diameter is too small.
4) The wires 610-*n* in Group 1 become taut.
5) The wires 610-*n* in Group 1 release from their respective crimps 640.
6) The wires 620-*n* in Group 2 become taut.
7) The wires 620-*n* in Group 2 release from their respective crimps 640.
8) The wires 630-*n* in Group 3 become taut.
9) The wires 630-*n* in group 3 release from their respective crimps 640.
10) All of the cable exits the end of the connector.

Figure 7:
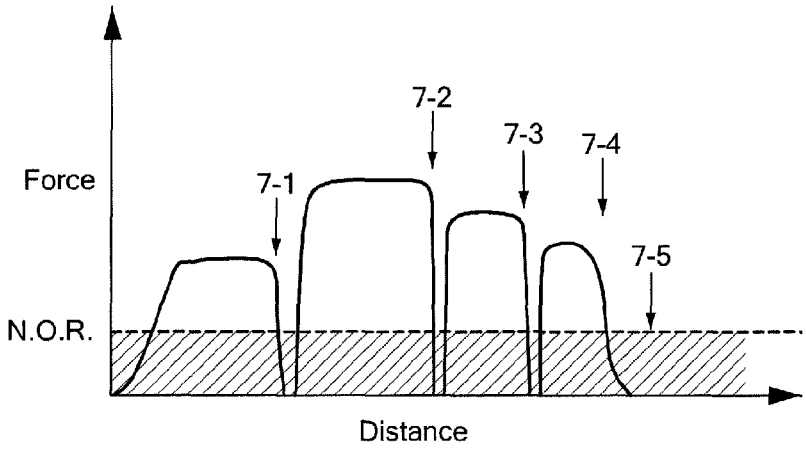
FIG. 7 is a graph of the release forces during operation of the breakaway cable of FIG. 4.

Referring now to FIG. 7, the graph describes the amount of force necessary to release where the sections are not additive. So, the compression clamp 606 and anti-rotation ring 602 release at a distance 7-1 and the force on the cable drops to almost zero, the Group 1 wires release at a distance 7-2 at a force higher than the force that caused the release of the compression clamp but not a function of that force, again the force drops and the Group 2 wires release at a distance 7-3 at a third value of force after which the force drops and then the Group 4 wires release at a distance 7-4 at value that is predictable because of the configuration of the crimps and the lengths of the wires and all of the wire is out of the plug at a distance 7-5.

It should be noted that the distance over which the wires release is in the range of 4-8 inches so the release happens relatively quickly. One understands that this occurs as the coiled cable is fully extended, due to the truck pulling away, after which the present invention reacts to protect the junction box by rupturing or breaking in a controlled manner. Advantageously, embodiments of the present invention may also serve to lessen the recoil of the cable after rupturing.

As known, the cables on these systems interconnect with one another using interlocking pins in combination with a "J-slot" to couple with the pins. Generally, the mechanical interlock that is created makes a connection similar to that found on a bayonet-style light bulb, an example of which will now be described with respect to FIGS. 10A-10D.

As shown, a plug housing 132, generally made of a durable plastic material, has an open end with a plurality of plug contacts 134 that are spring actuated by corresponding springs 136. An interlock pin 138 is provided and, as shown, there are two such interlock pins 138.1, 138.2. The functionality of the pins will be described in more detail below. A socket 140 is provided and includes two J-slots 142.1, 142.2 that are intended to couple with the corresponding interlock pins 138.1 and 138.2.

Figure 10A:
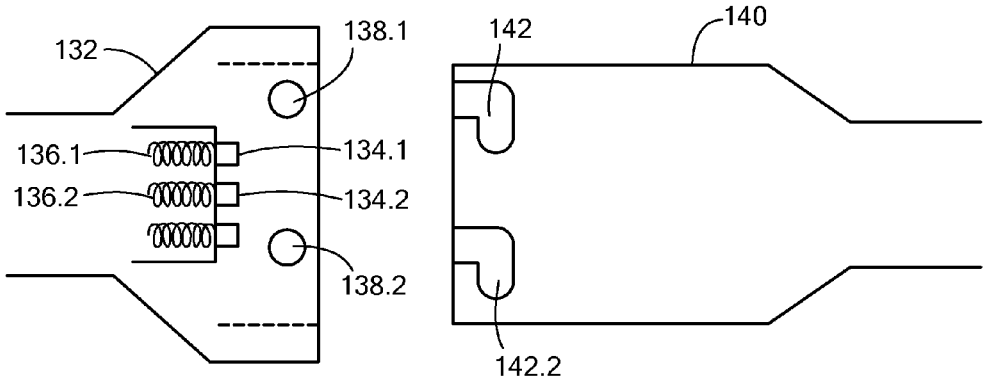
FIGS. 10A-10D are representations of known cable couplings.
Figure 10B:
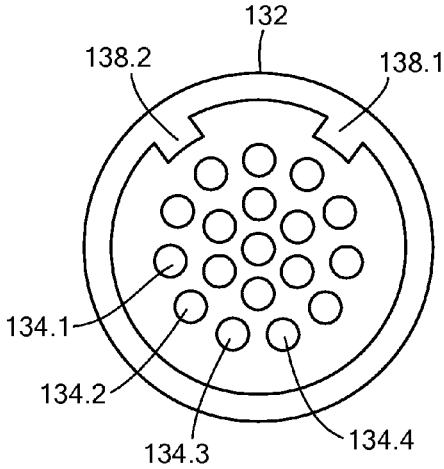
Figure 10C:
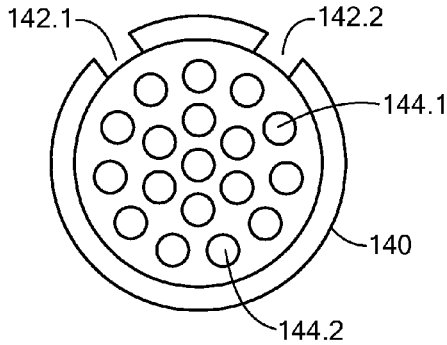

Referring now to FIGS. 10B and 10C, showing a view facing into the plug housing 132 and the socket 140, there is shown a pattern of plug contacts 134 corresponding to socket contacts 144. The interlock pins 138 align with the J-slots 142.

Figure 10D:
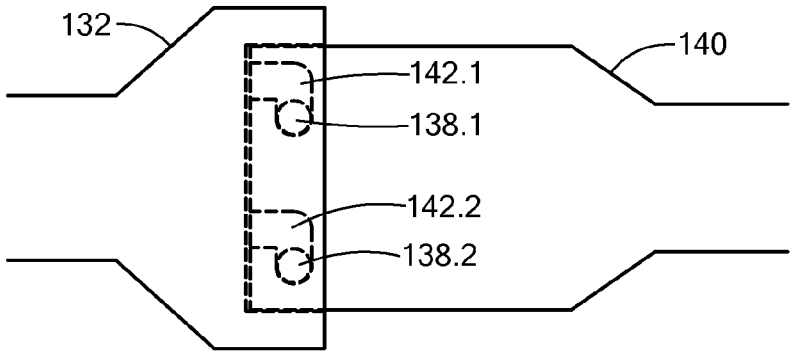

Thus, referring now to FIG. 10D, when the socket 140 is positioned within the plug 132 such that the J-slots 142 align with the interlock pins 138, a positive connection is made, i.e., an electrical connection, between the socket contacts 144 and the plug contacts 134. This has been presented as a general description of such a coupling and one of ordinary skill in the art understands the mechanics of this connection.

One shortcoming of a connection system that used only two interlock pins 138 is that as the number of plug contacts 134 increases, along with the spring forces behind them, it was observed that the mechanical coupling was intermittent in some cases. This was due to the fact that those plug contacts 134.1, 134.2, 134.3, 134.4, for example, disposed farther away from the two interlock pins 138, and the corresponding J-slots, would cause the socket 140 to "push away" or pivot as shown in FIG. 11.

Figure 11:
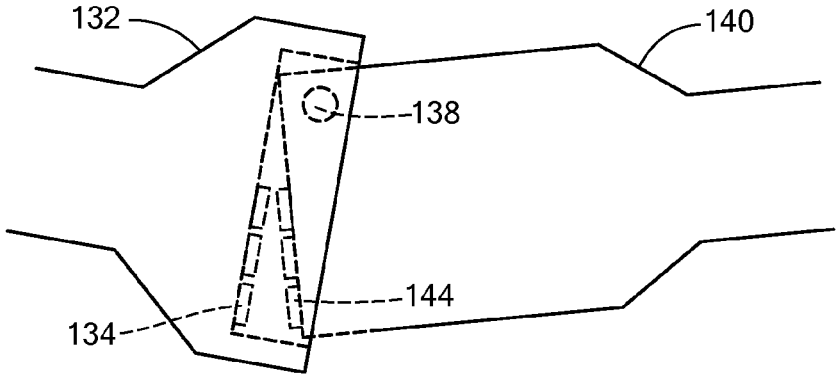
FIG. 11 is a representation of a known cable coupling resulting in "pivoting" due to contact pressure.

As can be seen in FIG. 11, the socket 140 is pivoting about the interlock pin 138 and, as a result, the lower plug contacts 134 and socket contacts 144 may only be intermittently connected. An intermittent connection can cause a false reading in an overfill detection system and either cause not enough fuel to be loaded into a tanker or, even worse, too much fuel to be loaded which could then be the cause of a spill.

Figure 12:
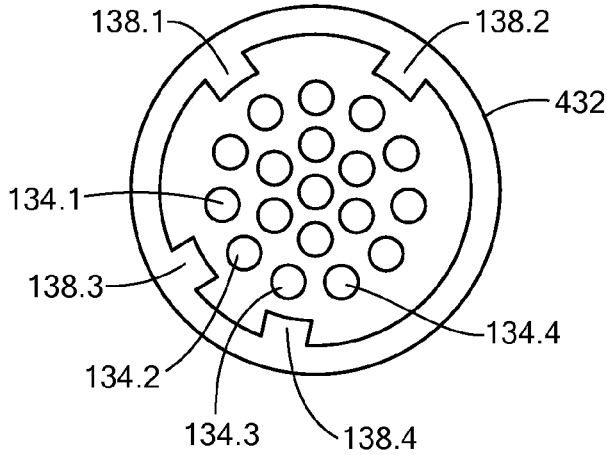
FIG. 12 is a front-end view of a four pin connector.

To compensate for the shortcomings of the two-pin design, two more pins 138 were added, as shown in FIG. 12. Thus, a plug housing 432 now includes four interlock pins 138.1, 138.2, 138.3 and 138.4. The additionally located interlock pins 138.3 and 138.4 couple to two additional J-slots, thus, giving the connection four points of contact.

As there was a large number of two pin plugs already in use, the new socket with four J-slots was designed to be backwards compatible such that a socket with four J-slots could accept a two pin plug, but an old style socket with two J-slots cannot accept a plug with four interlock pins. As a result, there are trucks and systems that use both two and four J-slots sockets, while the loading racks use plugs with two interlock pins that will fit any truck.

The issue as to the offset, i.e., the uneven spring pressure on a truck's socket is somewhat mitigated, however, by the physical structure and the way the socket is mounted on the truck.

Figure 13:
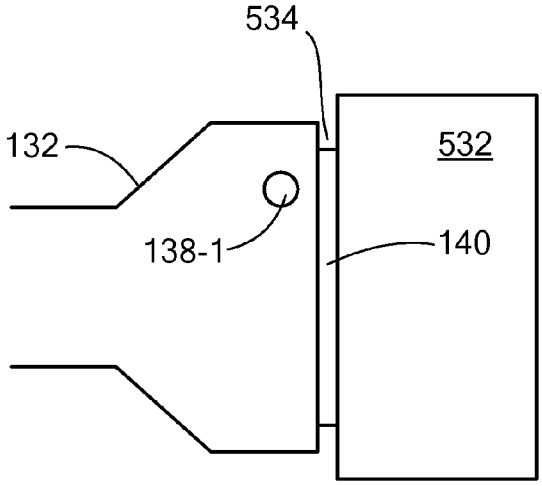
FIG. 13 is a schematic view of a truck-mounted coupling.

Referring now to FIG. 13, a truck socket 140 is generally mounted on a mounting plate 532 such that when the plug 132 is coupled to the socket 140 there is very little travel between the two. As shown, a gap 534 is provided with a predetermined dimension such that the plug 132 cannot pivot sufficiently to lose electrical contact between the plug contacts and the socket contacts. Of course, enough room remains such that the plug 132 can be "pushed" toward the mounting plate 532 in order to decouple the plug 132 from the socket 140.

As described above, however, the breakaway cable connector is not mounted in a mounting plate 532. As a result, the issue of pivoting again arises as the spring-actuated contacts 134 are free to expand to their maximum travel distance resulting in contact pressure that varies dramatically across the electrical connector.

Accordingly, what is needed is an approach to prevent the pivoting and subsequent loss of contact in the breakaway cable where no mounting plate is available.

A cable structure includes a retaining mechanism that maintains orientation of the plug with respect to the socket by keeping the two parts aligned and prevents rotation that might cause intermittent electrical connection.

Figure 14:
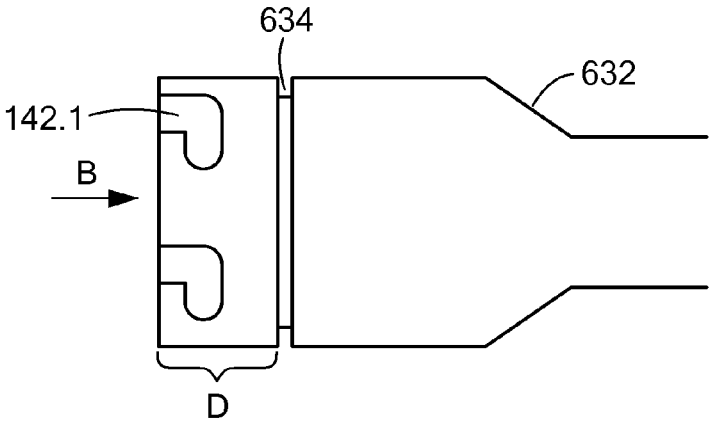
FIG. 14 is a representation of a connector in accordance with an embodiment of the present invention.

Referring now to FIG. 14, a socket 632 in accordance with one embodiment of the present invention includes a groove 634 running circumferentially around the circular part of the housing. The groove 634 is located a predetermined distance back from the distal end of the housing as marked by the distance D.

Figure 15:
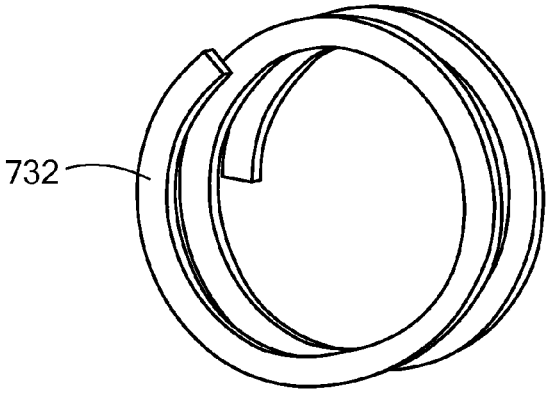
FIG. 15 is a retaining ring in accordance with one embodiment of the present invention.
Figure 16:
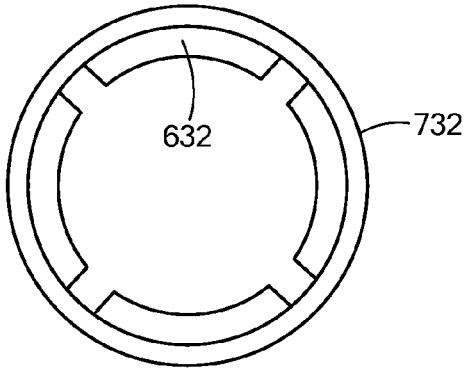
FIG. 16 is a front-view of the retaining ring of FIG. 15 disposed on the connector of FIG. 15.
Figure 17:
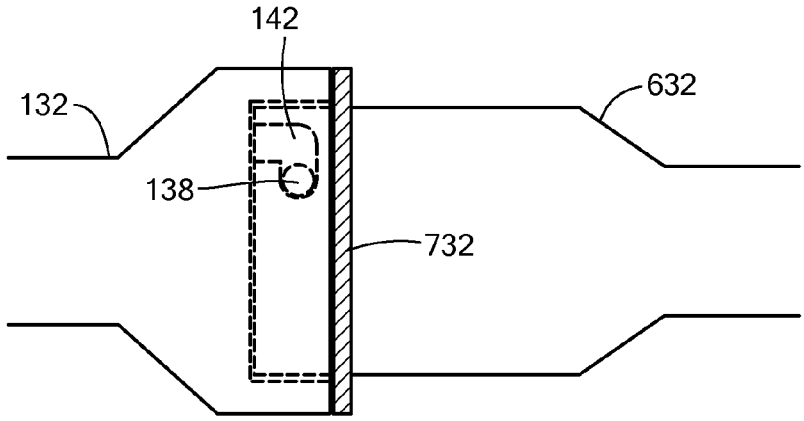
FIG. 17 is a representation of the connector of FIG. 14 coupled to a plug.

A retaining ring 732, as shown in FIG. 15, is provided in the groove 634 to prevent the wobbling of the socket 632 when coupled to a plug. The retaining ring 732 may be made from any appropriate material such as, for example, spring steel or stainless steel, and in one embodiment, is configured as a loop similar to a spiral ring. The retaining ring 732 has an outside diameter that is larger than the socket 632, as shown in FIG. 16 which is looking into the socket 632 from the direction B shown in FIG. 14.

Accordingly, when the socket 632 is coupled to the plug 132 and the interlock pin 138 couples with the J-slot 142, the retaining ring 732 is then slid up along the socket body and positioned so as to snap into the groove 634. Once fitted in this way, a tool, for example, a screwdriver or similar device, is required to remove the spiral spring clip 732 in order to disconnect the connector. Advantageously, the retaining clip 732 provides constant contact pressure for a two J-slot system as well as providing additional security against theft in that the coupling is maintained because a separate tool is needed to decouple the socket 632 from the plug 132.

Figure 18:
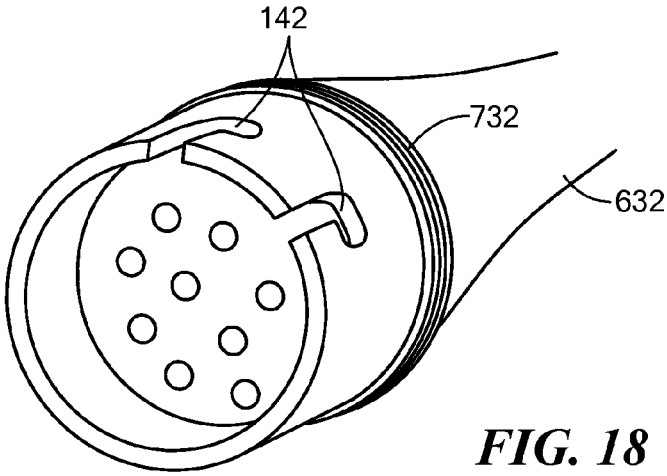
FIG. 18 is a perspective view of the connector of FIG. 14.

As shown in FIG. 18, the spring clip 732 is positioned in the groove 634 set back from the opening of the housing 632.

An embodiment of the present invention has been described where a spring has been used to maintain the connection of the socket and the plug. By positioning the groove, and the spring clip in the groove, the socket with the J-slots is prevented from being moved, i.e., the socket is maintained in a position that keeps the connectors aligned because the pins in the J-slots cannot be disengaged. Thus, a security feature against theft, in that the connection does not come undone unless manipulated with a tool, is provided along with a better mechanical alignment of the pins.

Figure 19:
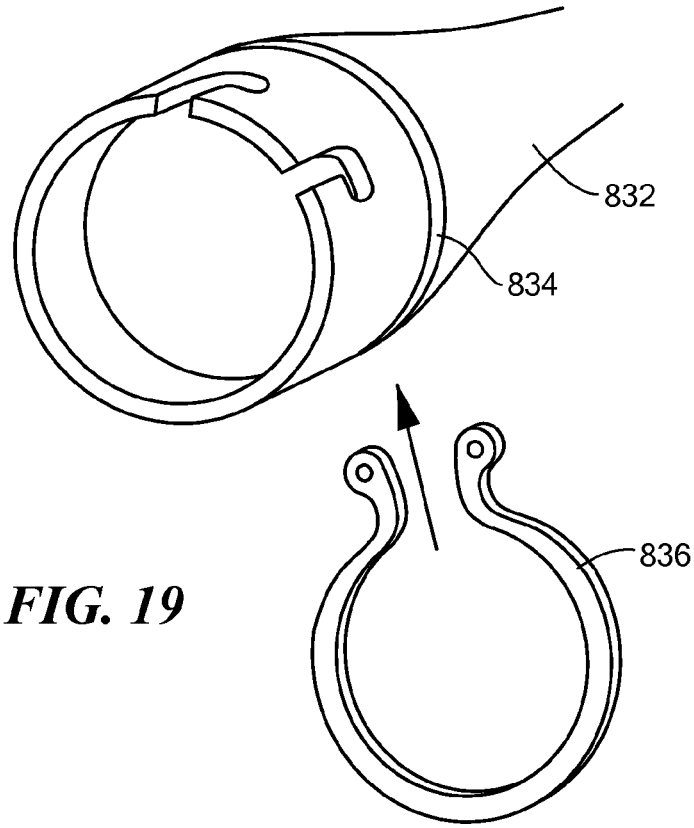
FIG. 19 is a perspective view of a connector and retaining clip in accordance with another embodiment of the present invention.

Alternatively, rather than a spiral spring clip as has been described, an open-ended clip, as shown in FIG. 19, can be provided. As shown, a socket 832 includes a groove 834 placed in a similar location as described above. After a corresponding plug is coupled to the socket 832, an open retaining clip 836 is then slid into the groove 834 to prevent movement of the plug with respect to the J-slot. In other words, similar to the previously described embodiments, the open retaining clip 836 prevents the movement of the plug needed to disengage from the J-slots. The open retaining clip 836 has a geometry and size that allows it to prevent the plug from moving out of the J-slots. The open retaining clip 836 can be made from any material, e.g., spring steel or stainless steel, that keeps its shape, has an appropriate amount of springiness in order to allow it to slide or clip into the groove and yet maintains itself in the groove.

Figure 20:
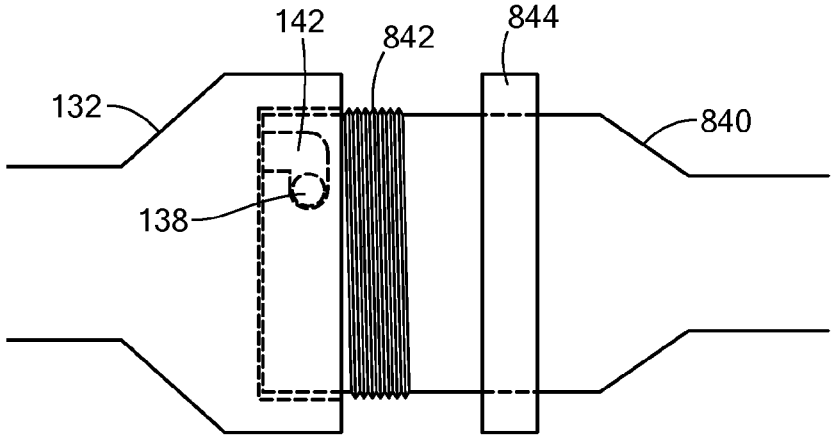
FIG. 20 is a schematic view of another embodiment of the present invention.

In another embodiment of the present invention, a nut and thread assembly are used to maintain the connection. As shown in FIG. 20, a socket 840 includes a thread 842 in a location as taught by the embodiments described above. A retaining nut 844 is slid from the proximal end and screwed into the thread once the plug 132 is coupled to the socket 840. Once threaded into place, the retaining nut 844 prevents the plug from decoupling from the J-slots.

The plug and socket are coupled to one another by pushing and rotating into the "bayonet-style" J-slots before either the open retaining clip 836 or the spiral spring clip 732 is positioned in its respective groove or before the retaining nut 844 is screwed into place.

In addition, indicators, such as seals, markings, etc., can be provided to indicate that the retaining clip or nut has been removed and replaced. This might be an indication that, at one time, the connector was disconnected. The clip or nut may be permanently positioned by, for example, being glued or soldered into place.

Having thus described several features of at least one embodiment of the present invention, it is to be appreciated that various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. An extension cable comprising:

a cable having a cable jacket and a plurality of wires extending from a free end of the cable jacket;

a first group of wires of the plurality of wires extending a first distance L1 from the cable jacket free end;

a second group of wires of the plurality of wires extending a second distance L2 from the cable jacket free end; and a third group of wires of the plurality of wires extending a third distance L3 from the cable jacket free end, a plug assembly having an inner puck portion, the plug assembly disposed around the cable;

an anti-rotation ring within the plug assembly and disposed around the cable, the anti-rotation ring comprising ears to mate with a matching pocket in the plug assembly; and a compression clamp disposed about the cable at a location adjacent the plug assembly, wherein a free end of each wire in each of the first, second and third groups of wires is terminated in a connector coupled to the inner puck portion, and wherein L1<L2<L3.

2. The extension cable of claim 1, wherein each connector is attached to a respective wire in a same manner.

3. The extension cable of claim 2, wherein a same predetermined amount of force is necessary to remove the wire from its respective connector.

4. The extension cable of claim 3, wherein each connector is crimped onto its respective wire.

5. The extension cable of claim 1, wherein each connector is coupled to the inner puck portion by a screw.

6. The extension cable of claim 5, wherein each screw is tightened with a same predetermined amount of force.

7. The extension cable of claim 1, wherein the connector is disposed in a cylindrical housing, the housing further comprising:

a circumferential groove running about an outer surface of the cylindrical housing; and a retaining ring disposed in the circumferential groove.

8. The extension cable of claim 7, wherein the retaining ring is sized to extend from the groove to be above the outer surface of the cylindrical housing.

9. The extension cable of claim 8, wherein the retaining ring is one of: a single loop; a spiral; and a U-shaped clip.

10. A breakaway extension cable assembly comprising:

a multi-wire cable comprising an outer sheath and a plurality of wires disposed within and extending from a distal end of the outer sheath;

a connector puck comprising a plurality of connector locations;

a first plurality of the wires extending a first predetermined distance L1 from the distal end of the outer sheath, each wire connected to a respective connector location on the puck;

a second plurality of the wires extending a second predetermined distance L2 from the distal end of the outer sheath, each wire connected to a respective connector location on the puck;

an anti-rotation ring disposed about the multi-wire cable a predetermined distance back from the distal end of the outer sheath;

a cylindrical plug housing disposed about the distal end of the outer sheath; and a compression clamp disposed about the cable adjacent a proximal end of the plug housing, wherein the puck is disposed in the plug housing, and wherein the anti-rotation ring is disposed within an orientation pocket located in the plug housing.

11. The breakaway extension cable assembly of claim 10, wherein L2>L1.

12. The breakaway extension cable assembly of claim 10, wherein:

a free end of each wire is terminated in a connector.

13. The breakaway extension cable assembly of claim 12, wherein each connector is attached to a respective wire in a same manner.

14. The breakaway extension cable assembly of claim 13, wherein a same predetermined amount of force is necessary to remove the wire from its respective connector.

15. The breakaway extension cable assembly of claim 14, wherein each connector is crimped onto its respective wire.

16. The breakaway extension cable assembly of claim 12, wherein each connector is coupled to the puck by a screw.

17. The breakaway extension cable assembly of claim 16, wherein each screw is tightened with a same predetermined amount of force.

18. The breakaway extension cable assembly of claim 10, further comprising:

a circumferential groove running about an outer surface of the cylindrical plug housing; and a retaining ring disposed in the circumferential groove.

19. The breakaway extension cable assembly of claim 18, wherein the retaining ring is sized to extend from the groove to be above the outer surface of the cylindrical plug housing.

20. The breakaway extension cable assembly of claim 19, wherein the retaining ring is one of: a single loop; a spiral; and a U-shaped clip.

21. The breakaway extension cable assembly of claim 11, further comprising:

a third plurality of the wires extending a third predetermined distance L3 from the distal end of the outer sheath, each wire connected to a respective connector location on the puck, wherein L3>L2>L1.

* * * * *